US011965300B2

(12) United States Patent
Zijlmans et al.

(10) Patent No.: US 11,965,300 B2
(45) Date of Patent: Apr. 23, 2024

(54) SYSTEM AND A METHOD FOR CONTROLLING A MOTION COMPENSATED PILE GUIDE FOR A FLOATING VESSEL, AND A VESSEL

(71) Applicant: IQIP HOLDING B.V., Sliedrecht (NL)

(72) Inventors: Jurgen Arjan Zijlmans, Delft (NL); Peter Martijn Van Den Bergh, Delft (NL); Jacob Osnabrugge, Delft (NL)

(73) Assignee: IQIP HOLDING B.V. (NL)

( * ) Notice: Subject to any disclaimer, the term of this patent is extended or adjusted under 35 U.S.C. 154(b) by 185 days.

(21) Appl. No.: 17/757,481

(22) PCT Filed: Dec. 15, 2020

(86) PCT No.: PCT/NL2020/050786
§ 371 (c)(1),
(2) Date: Jun. 16, 2022

(87) PCT Pub. No.: WO2021/125943
PCT Pub. Date: Jun. 24, 2021

(65) Prior Publication Data

US 2023/0348240 A1 Nov. 2, 2023

(30) Foreign Application Priority Data

Dec. 20, 2019 (NL) ..... 2024525

(51) Int. Cl.
*E02D 13/04* (2006.01)
*E02B 17/00* (2006.01)
*E02D 7/06* (2006.01)

(52) U.S. Cl.
CPC ..... *E02D 13/04* (2013.01); *E02D 7/06* (2013.01); *E02B 2017/0065* (2013.01)

(58) Field of Classification Search
CPC ... E02D 7/06; E02D 13/04; E02B 2017/0065; E02B 2017/0039
See application file for complete search history.

(56) References Cited

U.S. PATENT DOCUMENTS 6,659,703 B1 * 12/2003 Kirkley ..... B63B 27/10 414/139.6
2010/0032543 A1 2/2010 Van Der Tempel et al.
2018/0106007 A1 4/2018 Mack

FOREIGN PATENT DOCUMENTS

CN 102660950 A 9/2012
CN 105339554 A 2/2016
(Continued)

OTHER PUBLICATIONS

First Office Action for corresponding Chinese application No. 2080086783.3; dated Jun. 7, 2023 (28 pages) Machine Translation.
(Continued)

*Primary Examiner* — Janine M Kreck
(74) *Attorney, Agent, or Firm* — Mendelsohn Dunleavy, P.C.

(57) ABSTRACT

A system for controlling a motion compensated pile guide for a floating vessel comprises a pile guide for guiding a monopile in its longitudinal direction during driving the monopile into a seabed, an actuator for moving the pile guide in horizontal direction with respect to a vessel to which the pile guide is mounted, a control unit for controlling the actuator, which control unit is configured for compensating motion of the vessel to which the pile guide is mounted so as to maintain the horizontal position of the pile guide during driving a monopile into a seabed, a first sensor for determining an inclination angle of a monopile with respect to the vertical during driving the monopile into a seabed, and a second sensor for determining magnitude and direction of an actual force of a monopile onto the pile guide
(Continued)

during driving the monopile into a seabed. The control unit is configured to determine a desired force of the pile guide onto the monopile for minimizing the inclination angle when determined by the first sensor, and to control the actuator for moving the pile guide opposite to the direction of the actual force when the desired force is larger than the actual force and in the same direction as the actual force when the actual force is larger than the desired force.

20 Claims, 4 Drawing Sheets

(56) References Cited

FOREIGN PATENT DOCUMENTS

| | | | |
|---|---|---|---|
| CN | 206173964 | U | 5/2017 |
| CN | 106948330 | A | 7/2017 |
| CN | 108884647 | A | 11/2018 |
| CN | 109024599 | A | 12/2018 |
| CN | 109881676 | A | 6/2019 |
| CN | 110325776 | A | 10/2019 |
| CN | 110331723 | A | 10/2019 |
| EP | 2886722 | A1 | 6/2015 |
| JP | H01-219215 | A | 9/1989 |
| WO | 2016105187 | A1 | 6/2016 |

OTHER PUBLICATIONS

International Search Report and Written Opinion for corresponding International application No. PCT/NL2020/050786; dated Mar. 2, 2021 (15 pages).

* cited by examiner

SYSTEM AND A METHOD FOR CONTROLLING A MOTION COMPENSATED PILE GUIDE FOR A FLOATING VESSEL, AND A VESSEL

The present invention relates to a system for controlling a motion compensated pile guide for a floating vessel, comprising a pile guide for guiding a monopile in its longitudinal direction during driving the monopile into a seabed, an actuator for moving the pile guide in horizontal direction with respect to a vessel to which the pile guide is mounted, a control unit for controlling the actuator, which control unit is configured for compensating motion of the vessel to which the pile guide is mounted so as to maintain the horizontal position of the pile guide during driving a monopile into a seabed.

Such a system is known in the art as a wave-induced motion compensated pile gripper. The existing system uses position control on the basis of continuous measurements of pile inclination and vessel movements. The actuator of the known system comprises a set of hydraulic cylinders for moving the pile guide or gripper with respect to the vessel to which it is mounted. This allows the gripper to compensate the disturbing vessel motions in surge and sway direction. The applicant has discovered that the control unit of the known system does not suffice when the monopile penetration depth increases during driving the monopile in the seabed. During progress of the penetration process relatively large forces may be exerted onto the gripper in case the inclination angle is larger than zero, which inclination may be caused by wave and current forces, an irregular soil structure and position control inaccuracy combined with a solid monopile-in-soil condition. When the gripper position is displaced in order to reduce the inclination angle the existing control for motion compensation can be disturbed, for example due to running out of its operating range or pushing the vessel out of range due to excessive force by the gripper. Another reason why the control unit of the known system does not suffice is that when the monopile penetration depth increases during driving the monopile in the seabed the "hinge" of the monopile in the ground will fixate, i.e. the monopile will be more resistant against correcting its orientation. Due to inaccuracy in the control for motion compensation combined with the decreasing hinge effect of the monopile in the seabed the forces between the monopile and the gripper may increase to an unacceptable level.

The present invention aims to provide an improved system.

For this purpose the system according to the invention is provided with a first sensor for determining an inclination angle of a monopile with respect to the vertical during driving the monopile into a seabed, a second sensor for determining magnitude and direction of an actual force of a monopile onto the pile guide during driving the monopile into a seabed, wherein the control unit is configured to determine a desired force of the pile guide onto the monopile for minimizing the inclination angle when determined by the first sensor, and to control the actuator for moving the pile guide opposite to the direction of the actual force when the desired force is larger than the actual force and in the same direction as the actual force when the actual force is larger than the desired force.

An advantage of the invention is that the configuration of the control unit causes a displacement of the pile guide opposite to the direction of the actual force only under certain conditions. This keeps the forces onto the pile guide within acceptable limits, hence preventing the motion control from running out of its operating range.

The operation of the control unit for compensating motion of the vessel may be indicated as being a motion control part and its operation for controlling the actuator through determining the desired force may be indicated as being a force control part. The simultaneous operation of the motion control part and the force control part according to the present invention may be indicated as being a hybrid control technique. The motion control part functions without the force control part when the monopile remains in a vertical orientation during pile driving. As soon as the monopile tends to incline, for example due to changing soil structure during penetrating the sea bed, the force control part will take action, as well. On the other hand, if the vessel does not move in a fully motionless situation, it is the force control part which may only take action in case of inclination of the monopile. However, most of the time both the motion control part and the force control part will take action simultaneously in practice.

The control unit may be configured such that when the desired force exceeds a predetermined force level, the desired force is set at the predetermined force level in order to avoid disturbance of the motion control which compensates motion of the vessel under operating conditions. Hence, the desired force lies below or is equal to the predetermined force level. In practice, the predetermined force level may a fixed level, whereas the magnitude of the desired force varies, depending on the actual conditions such as the inclination angle and the soil structure of the seabed.

The predetermined force level may be proportional to the maximum power of thrusters of the vessel to which the pile guide is mounted. This prevents the vessel from being pushed away from the monopile under operating conditions.

The capacity of the thrusters of the vessel may be smaller than the force capacity of the pile guide. During short periods ('bursts') this force capacity can be used for pushing the monopile back from its inclined orientation to its vertical orientation. The force control may set limits on vessel workability as it is more friendly for the motion control part.

In a practical embodiment the actuator comprises a set of hydraulic cylinders which are controllable by the control unit.

The second sensor may comprise pressure sensors for measuring pressure in the hydraulic cylinders. Alternatively, the actual force may be measured by means of one or more load pins at the pile guide.

The desired force may be determined by controlling the actuator to move the pile guide in a direction from an inclined orientation towards a vertical orientation of a monopile and determining increase rate of the actual force in relation to reduction of the inclination angle. This can be performed by means of a PID controller, for example.

Alternatively, the desired force may be determined on the basis of a relationship between soil structure of a seabed into which a monopile is driven and required force of the pile guide onto the monopile for moving the monopile from its inclined orientation towards a vertical orientation. This may be a model-based calculation in which the relationship is determined during pile driving.

The control unit may be provided with an algorithm for compensating motion of the vessel to which the pile guide is mounted, which algorithm uses the desired force as an input so as to anticipate on the forces that are going to be exerted on the pile guide.

The system may be provided with a hammer for driving a monopile into a seabed, wherein the first sensor is provided at the hammer.

In a practical embodiment the first sensor is an inclination sensor and the second sensor is a load sensor.

The invention is also related to a method for controlling a motion compensated pile guide for a floating vessel during driving a monopile into a seabed, wherein the monopile is guided in its longitudinal direction by the pile guide and the pile guide is moved in horizontal direction for compensating motion of the vessel to which the pile guide is mounted, wherein an inclination angle of the monopile with respect to the vertical and magnitude and direction of an actual force of the monopile onto the pile guide are determined during driving the monopile into the seabed, wherein a desired force of the pile guide onto the monopile for minimizing a detected inclination angle is determined, and wherein the pile guide is moved opposite to the direction of the actual force when the desired force is larger than the actual force and in the same direction as the actual force when the actual force is larger than the desired force.

The desired force may be set at the predetermined force level when the desired force exceeds a predetermined force level in order to avoid disturbance of the motion position control.

The desired force may be determined by moving the pile guide in a direction from an inclined orientation towards a vertical orientation of the monopile and determining increase rate of the actual force in relation to reduction of the inclination angle.

Alternatively, the desired force may be determined on the basis of a relationship between soil structure of the seabed into which the monopile is driven and required force of the pile guide onto the monopile for moving the monopile from its inclined orientation towards a vertical orientation.

The invention is also related to a vessel which comprises the system as defined hereinbefore. The above-identified motion control part and force control part may be implemented in different submodules in the vessel.

The invention will hereafter be elucidated with reference to the schematic drawings showing an embodiment of the invention by way of example.

Figure 1:
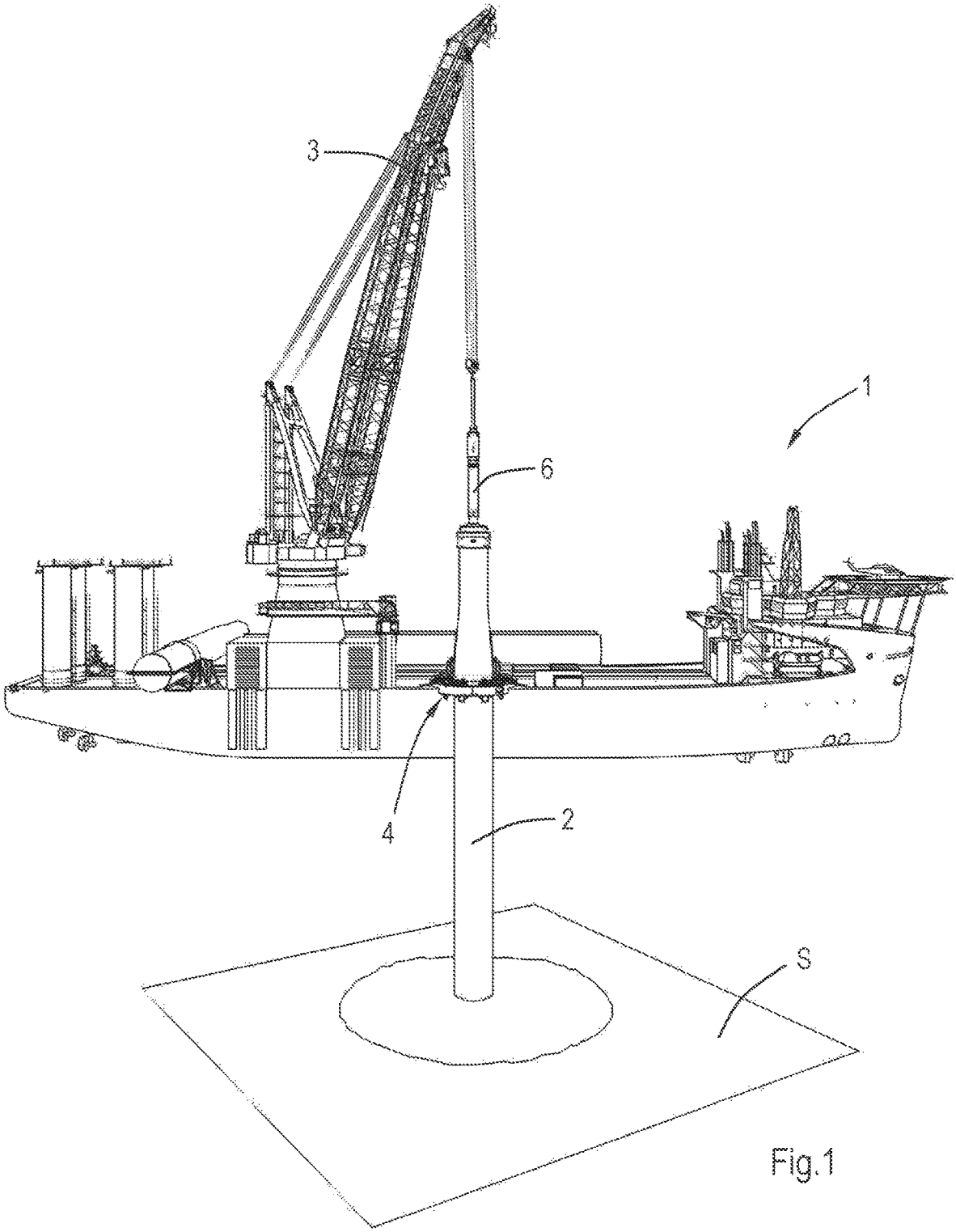
FIG. 1 is a perspective view of a vessel including an embodiment of a system for controlling a motion compensated pile guide according to the invention.
Figure 2:
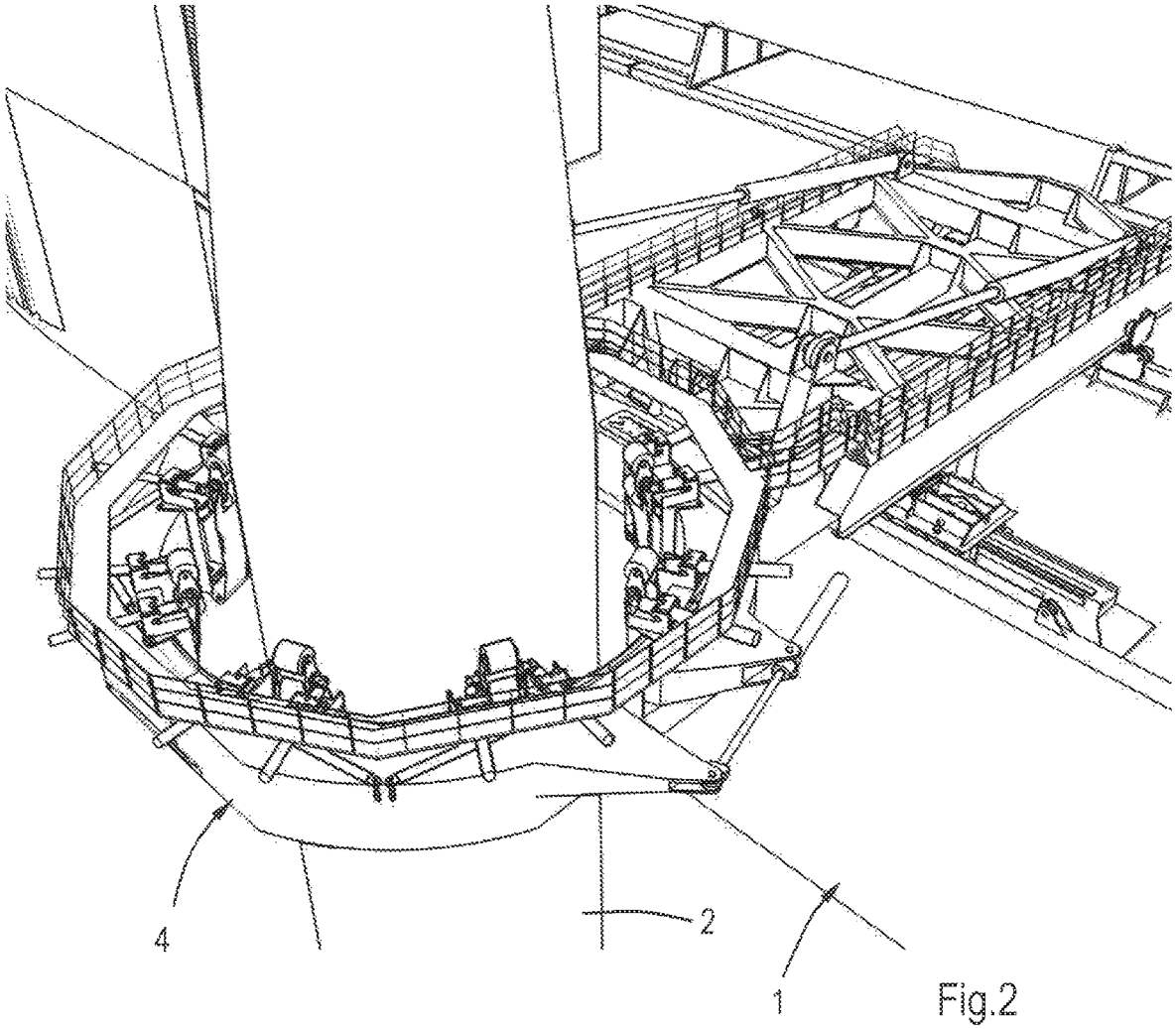
FIG. 2 is an enlarged perspective view of a part of the vessel as shown in FIG. 1.
Figure 3:
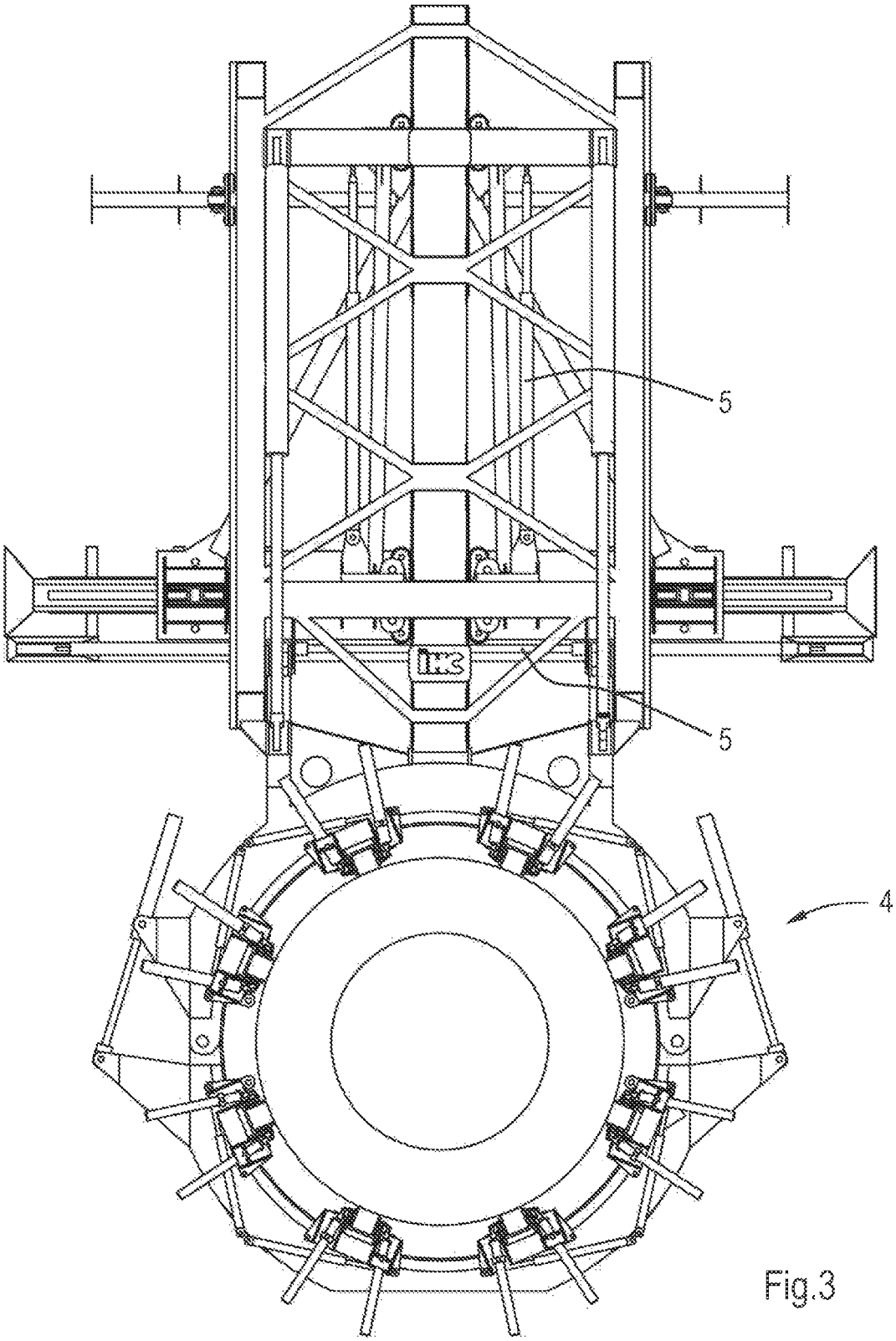
FIG. 3 is a top view of the motion compensated pile guide mounted to the vessel of FIG. 1.

FIG. 1 shows a floating installation vessel 1 for installing a monopile 2 in a seabed S. The installation vessel 1 is provided with a crane 3 for lifting the monopile 2. FIGS. 1-3 show a motion compensated pile guide 4 for guiding the monopile 2 in its longitudinal direction during driving the monopile 2 into the seabed S. The pile guide 4 is mounted to the vessel 1 and movable in horizontal direction with respect to the vessel 1 by an actuator in the form of hydraulic cylinders 5, i.e. in longitudinal and sideward direction or X and Y direction in order to compensate for vessel motions. The pile guide 4 can be opened and closed in a well-known manner in order to enclose the monopile 2. The function of the pile guide 4 is to install the monopile 2 vertically from the beginning of the operation until it is hammered deep enough such that it is supported by the soil to stand safely upright on its own.

Under operating conditions, the monopile 2 is transported horizontally by the vessel 1 from a production facility to an off-shore installation site. Before the monopile 2 is installed it is up-ended by means of the crane 3, after which the monopile 2 suspends vertically from the crane 3. Subsequently, the monopile 2 is lowered and placed onto the seabed S. Depending on the soil structure the monopile 2 may first penetrate the seabed S to a certain depth due to its own weight. Alternatively, the monopile 2 may be up-ended by means of an independent system or a pile-guide integrated upend system (not shown). The pile guide 4 is coupled to the monopile 2 and a pile driving hammer 6 is placed on top of the monopile 2 by the crane 3 in order to drive the monopile 2 into the seabed S. The pile guide 4 is controlled by the hydraulic cylinders 5 to maintain a vertical orientation of the monopile 2. Installing a monopile 2 from a floating vessel as such allows higher pay-loads and crane capacities than jack-up barges, but is challenging because of wave-induced vessel motions and strict monopile vertical installation tolerances.

Figure 4:
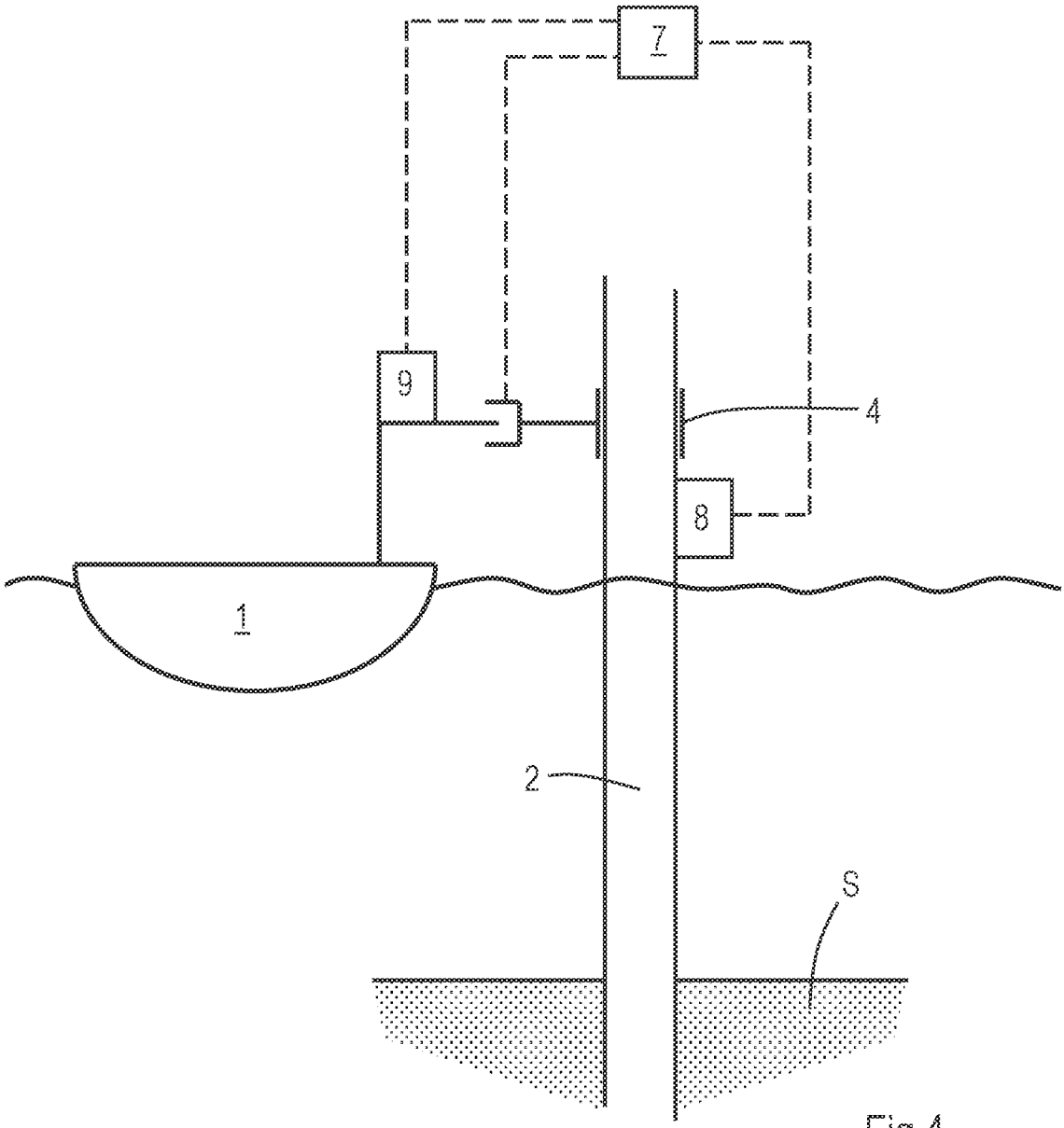
FIG. 4 is a diagram which illustrates an embodiment of the system for controlling the motion compensated pile guide of FIG. 3.

The installation vessel 1 is provided with a system for controlling the motion compensated pile guide 4, which is illustrated by a diagram in FIG. 4. In addition to the pile guide 4 and the hydraulic cylinders 5 the system comprises a control unit 7 for controlling the hydraulic cylinders 5, an inclination sensor 8 for determining an inclination angle of the monopile 2 with respect to the vertical during driving the monopile 2 into the seabed S and pressure sensors 9 for measuring pressure in the hydraulic cylinders 5 in order to determine magnitude and direction of an actual force of the monopile 2 onto the pile guide 4 during driving the monopile 2 into the seabed S. In FIG. 4 the inclination sensor 8 is shown next to the monopile 2, but in an alternative embodiment it may be located at the pile driving hammer 6.

The control unit 7 is configured for compensating motion of the vessel 1 so as to maintain the horizontal position of the pile guide 4 during driving the monopile 2 into the seabed S. Such a control is based on conventional active vessel motion compensation that intends to position the pile guide 4 geostationary and is well-known. It tries to move the pile guide 4 exactly opposite of the vessel motion such that the pile guide 4 stands still in horizontal direction and the monopile 2 remains upright. Forces of the pile guide 4 acting on the vessel 1 may disturb positioning of the vessel 1. Therefore, the control unit 7 according to the present invention is also configured to determine a desired force of the pile guide 4 onto the monopile 2 for minimizing the inclination angle in the event that the inclination sensor 8 detects an inclination angle. A response of the control unit 7 to detecting an inclination angle may be that the hydraulic cylinders 5 are operated such that they move the pile guide 4 opposite to the direction of the actual force. However, this response only happens when the desired force is larger than the actual force. If the actual force is larger than the desired force the hydraulic cylinders 5 are operated such that they move in the same direction as the actual force. The latter conditional control step serves to prevent the compensation control for wave-induced motion from running out of its operating range, resulting in unstable motion control.

The desired force of the pile guide 4 onto the monopile 2 for minimizing the inclination angle can be determined in different ways. For example, the desired force is determined by operating the hydraulic cylinders 5 such that they move the pile guide 4 in a direction from an inclined orientation towards a vertical orientation of the monopile 2, whereas an increase of the actual force in relation to reduction of the inclination angle is determined. This can be achieved by means of a PID controller, which increases the pressure in the hydraulic cylinders 5 step-by-step in order to obtain a relationship between the reduction of inclination angle and force of the pile guide 4 onto the monopile 2. From this relationship the desired force to tilt the monopile 2 back to its vertical orientation is derived. The desired force is compared with the actual force of the monopile 2 onto the pile guide 4. As stated above, the hydraulic cylinders 5 are operated such that they move the pile guide 4 opposite to the direction of the actual force when the desired force is larger than the actual force and in the same direction as the actual force when the actual force is larger than the desired force. Under operating conditions the actual force may follow the set desired force by a time delay, for example a few seconds, because of dynamics and system inertia and the selected speed of control. It is noted that a time delay on the force may increase the operational window of the system/vessel. Vessels allow a certain amount of time, for example five to eight seconds, of higher forces on the pile guide than the force which thrusters of the vessel can deliver.

An alternative way for determining the desired force of the pile guide 4 onto the monopile 2 for minimizing the inclination angle is based on a relationship between soil structure of a seabed into which a monopile 2 is driven and required force of the pile guide 4 onto the monopile 2 for moving the monopile 2 from its inclined orientation towards a vertical orientation. Such a relationship may be derived from a model of the soil structure and a penetrating monopile 2. Alternatively, there may also be a relationship between blow count and penetration of the monopile 2 per blow, which can be used to derive fixation of the monopile 2 in the seabed S in order to define a profile for force control in order to bring the monopile 2 in vertical orientation, i.e. to determine the desired force.

The control unit 7 is configured such that when the desired force exceeds a predetermined force level, the desired force is set at the predetermined force level. The predetermined force level is proportional to the maximum power of azimuth thrusters 10 of the vessel 1. This prevents the system from attempting to push the monopile 2 towards a vertical orientation whereas required force exceeds the maximum force of the azimuth thrusters 10 of the vessel 1.

The invention is not limited to the embodiment shown in the drawings and described hereinbefore, which may be varied in different manners within the scope of the claims and their technical equivalents.

The invention claimed is:

1. A system for controlling a motion compensated pile guide for a floating vessel, comprising a pile guide for guiding a monopile in its longitudinal direction during driving the monopile into a seabed, an actuator for moving the pile guide in a horizontal direction with respect to the floating vessel to which the pile guide is mounted, a control unit for controlling the actuator, which said control unit is configured for compensating motion of the floating vessel to which the pile guide is mounted so as to maintain a horizontal position of the pile guide during driving of the monopile into the seabed, a first sensor for determining an inclination angle of the monopile with respect to vertical during driving the monopile into the seabed, a second sensor for determining magnitude and direction of an actual force of the monopile onto the pile guide during driving the monopile into at the seabed, wherein the control unit is configured to determine a desired force of the pile guide onto the monopile for minimizing the inclination angle when determined by the first sensor, and to control the actuator for moving the pile guide in a direction opposite to the direction of the actual force when the desired force is larger than the actual force and in a same direction as the direction of the actual force when the actual force is larger than the desired force.

2. The system according to claim 1, wherein the control unit is configured such that when the desired force exceeds a predetermined force level, the desired force is set at the predetermined force level.

3. The system according to claim 2, wherein the predetermined force level is proportional to a maximum power of thrusters of the floating vessel which the pile guide is mounted.

4. The system according to claim 1, wherein the actuator comprises a set of hydraulic cylinders which are controllable by the control unit.

5. The system according to claim 4, wherein the second sensor comprises pressure sensors for measuring pressure in the hydraulic cylinders.

6. The system according to claim 1, wherein the desired force is determined by controlling the actuator to move the pile guide in a direction from an inclined orientation towards a vertical orientation of the monopile and determining an increase rate of the actual force in relation to a reduction of the inclination angle.

7. The system according to claim 1, wherein the desired force is determined based on a relationship between soil structure of the seabed into which the monopile is driven and a required force of the pile guide onto the monopile for moving the monopile from its inclined orientation towards a vertical orientation.

8. The system according to claim 1, wherein the control unit is provided with an algorithm for compensating motion of the floating vessel to which the pile guide is mounted, which algorithm uses the desired force as an input.

9. The system according to claim 1, wherein the system is provided with a hammer for driving the monopile into the seabed, and the first sensor is provided at the hammer.

10. The system according to claim 1, wherein the first sensor is an inclination sensor and the second sensor is a load sensor.

11. A vessel, comprising the system according to claim 1.

12. The system according to claim 1, wherein the control unit is configured such that when the desired force exceeds a predetermined force level, the desired force is set at the predetermined force level, the predetermined force level is proportional to a maximum power of thrusters of the floating vessel to which the pile guide is mounted, and the actuator comprises a set of hydraulic cylinders which are controllable by the control unit.

13. The system according to claim 12, wherein the second sensor comprises pressure sensors for measuring pressure in the hydraulic cylinders.

14. The system according to claim 1, wherein the desired force is determined based on a relationship between soil structure of the seabed into which the monopile is driven and a required force of the pile guide onto the monopile for moving the monopile from its inclined orientation towards a vertical orientation, and the control unit is provided with an algorithm for compensating motion of the floating vessel to which the pile guide is mounted, which algorithm uses the desired force as an input.

15. The system according to claim 14, wherein the system is provided with a hammer for driving the monopile into the seabed, and the first sensor is provided at the hammer.

16. The system according to claim 15, wherein the first sensor is an inclination sensor and the second sensor is a load sensor.

17. A method for controlling a motion compensated pile guide for a floating vessel during driving a monopile into a seabed, wherein the monopile is guided in its longitudinal direction by the pile guide and the pile guide is moved in a horizontal direction for compensating motion of the floating vessel to which the pile guide is mounted, said method comprising, determining an inclination angle of the monopile with respect to vertical and a magnitude and direction of an actual force of the monopile onto the pile guide during driving the monopile into the seabed, determining a desired force of the pile guide onto the monopile for minimizing the determined inclination angle, and moving the pile guide in a direction opposite to the direction of the actual force when the desired force is larger than the actual force and in a same direction as the direction of the actual force when the actual force is larger than the desired force.

18. The method according to claim 17, wherein when the desired force exceeds a predetermined force level the desired force is set at the predetermined force level.

19. The method according to claim 17, wherein the desired force is determined by moving the pile guide in a direction from an inclined orientation towards a vertical orientation of the monopile and determining an increase rate of the actual force in relation to a reduction of the inclination angle.

20. The method according to claim 17, wherein, the desired force is determined based on a relationship between soil structure of the seabed into which the monopile is driven and a required force of the pile guide onto the monopile for moving the monopile from its inclined orientation towards a vertical orientation.

* * * * *